US007850550B2

(12) United States Patent
Nania et al.

(10) Patent No.: US 7,850,550 B2
(45) Date of Patent: Dec. 14, 2010

(54) MULTIPURPOSE GOLF TOOL

(76) Inventors: John J. Nania, 879 Embury Rd., Penfield, NY (US) 14526; Philip Dinato, 34 Carrington Dr., Rochester, NY (US) 14626

( * ) Notice: Subject to any disclaimer, the term of this patent is extended or adjusted under 35 U.S.C. 154(b) by 0 days.

(21) Appl. No.: 12/494,983

(22) Filed: Jun. 30, 2009

(65) Prior Publication Data

US 2009/0325734 A1 Dec. 31, 2009

Related U.S. Application Data

(60) Provisional application No. 61/077,032, filed on Jun. 30, 2008.

(51) Int. Cl.
*A63B 57/00* (2006.01)

(52) U.S. Cl. ..... 473/408; 473/386

(58) Field of Classification Search ..... 473/386, 473/387, 403; D21/717, 718, 793
See application file for complete search history.

(56) References Cited

U.S. PATENT DOCUMENTS

| | | | | | |
|---|---|---|---|---|---|
| 2,801,852 | A | * | 8/1957 | Hottle | 473/386 |
| 2,950,110 | A | | 8/1960 | Slotta | |
| 3,540,727 | A | * | 11/1970 | Solomon, Jr. | 473/386 |
| 3,658,331 | A | * | 4/1972 | Driscoll | 473/386 |
| 3,907,289 | A | * | 9/1975 | Bondu, Sr. | 473/403 |
| 4,535,987 | A | | 8/1985 | Dikoff | |
| D302,714 | S | * | 8/1989 | Chatham | D21/793 |
| 4,896,883 | A | * | 1/1990 | Wagenknecht | 473/386 |
| 4,982,510 | A | * | 1/1991 | Musillo | 473/386 |
| D314,922 | S | * | 2/1991 | Musillo | D10/64 |
| 4,989,868 | A | * | 2/1991 | Manko | 473/386 |
| D344,779 | S | * | 3/1994 | Axne | D21/793 |
| 5,419,551 | A | | 5/1995 | Hoyt et al. | |
| 5,634,862 | A | * | 6/1997 | Gamache | 473/386 |
| 5,643,113 | A | | 7/1997 | Rodgers | |
| 5,645,500 | A | * | 7/1997 | Borden | 473/408 |
| 5,728,012 | A | * | 3/1998 | Boelling | 473/386 |
| 5,735,758 | A | * | 4/1998 | Miketinac | 473/386 |
| 5,913,737 | A | * | 6/1999 | Park | 473/386 |
| 6,009,584 | A | | 1/2000 | Padden | |
| 6,220,973 | B1 | | 4/2001 | Hsu | |
| 6,413,173 | B1 | | 7/2002 | Muller et al. | |
| D468,385 | S | * | 1/2003 | Fleischmann | D21/793 |
| D473,279 | S | * | 4/2003 | Fleischmann | D21/793 |
| 7,223,184 | B2 | | 5/2007 | Suwito | |
| 2005/0261088 | A1 | * | 11/2005 | Suwito | 473/386 |
| 2008/0188328 | A1 | * | 8/2008 | Joffe | 473/386 |

FOREIGN PATENT DOCUMENTS

| | | |
|---|---|---|
| WO | WO0230524 | 4/2002 |

OTHER PUBLICATIONS

Golf Cow, The Heater Holder Cigar Holder, webpage, Golf Cow, Inc., http://www.golfcow.com/golf/catalog/accessories/divot_tools/tool_logic_golf_card.html?item=10514, 2009.

* cited by examiner

*Primary Examiner*—Steven Wong
(74) *Attorney, Agent, or Firm*—Tracy P. Jong

(57) ABSTRACT

There is provided an improved pocket golf tool comprising a golf tee angle adjuster, together with one or more of the following components: golf tee leveler, a golf tee height adjuster, a divot repairer, a club face cleaner, a ball marker, and an object rest. In a preferred embodiment, all of these components are incorporated in the golf tool.

17 Claims, 7 Drawing Sheets

FIG. 3
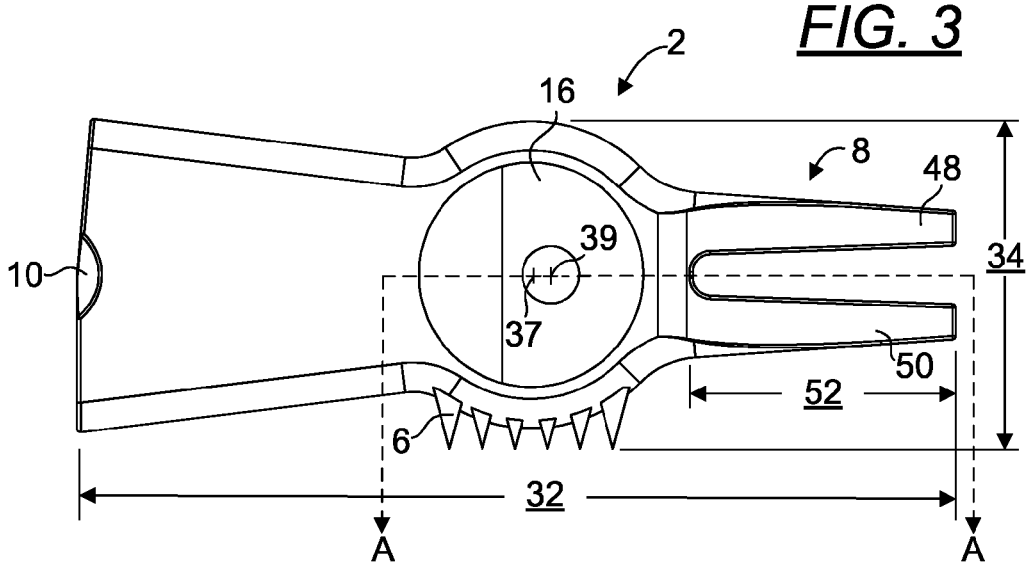
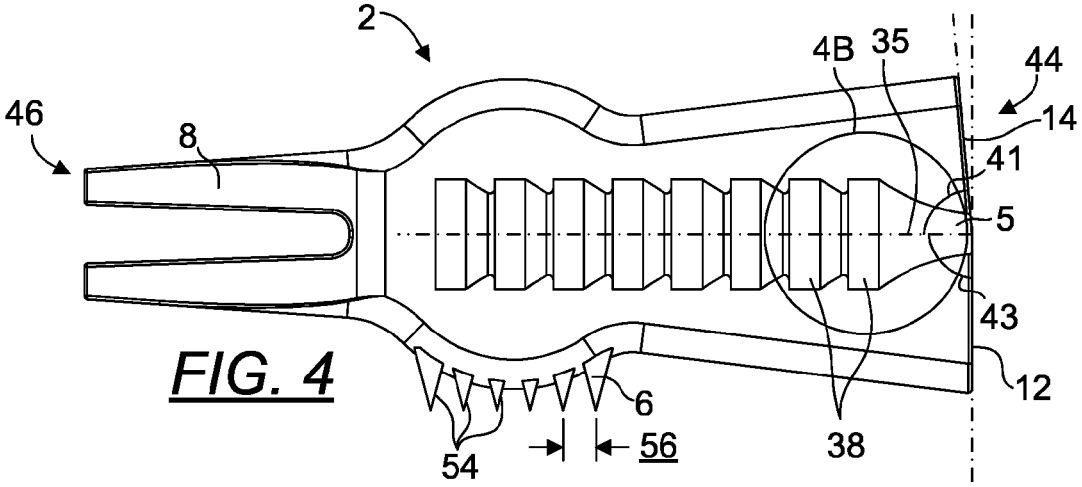
FIG. 4
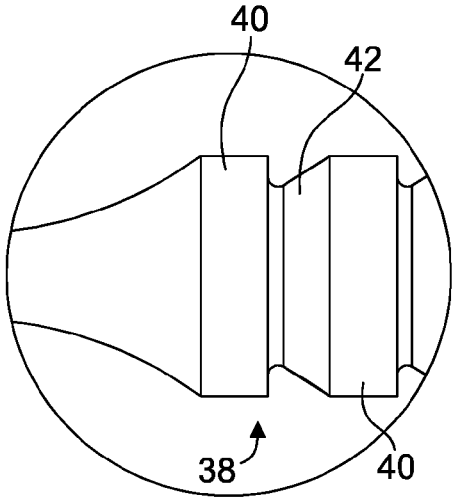
FIG. 4B

MULTIPURPOSE GOLF TOOL

CROSS REFERENCE TO RELATED APPLICATIONS AND PRIORITY CLAIM

This application claims the benefit of priority from provisional U.S. Ser. No. 61/077,032 filed Jun. 30, 2008.

FIELD OF THE INVENTION

This invention relates to golf tools and more particularly, to a novel multipurpose golf tool designed to set a golf tee at a desired height and angle to correct or enhance a golfer's swing. The present invention is a golf tool that cleans golf clubs, provides a stand or holder for golf clubs, corrects divots, provides a golf ball marker, and sets a golf tee at a desired height and angle.

BACKGROUND

There are many golf aids and pocket tools available to assist golfers. There are various tools and devices to clean golf clubs, provides a stand or holder for golf clubs, correct divots, provide a golf ball marker, and set a golf tee. While some of these prior art golf tools have gained popularity, they are not capable of allowing a golfer to set a golf tee at a predetermined angle.

In recent years, drivers have increased in shaft length and club head size. In order to optimize launch, a golfer may require adjustments when making a tee shot. For example, a taller clubface generally requires a higher tee height for the golfer to hit the golf ball with the middle of the clubface. Also, if maximum height is desired on a tee shot, it is preferable to tee the golf ball at an impact point higher than the center of the clubface. Hitting a golf ball just about the true middle of the club face launches the golf ball higher while minimizing backspin. A golfer's game is improved when he can consistently set his golf tee at a particular predetermined height.

A golfer's game is further improved when he can consistently set his golf tee at a small angle with respect to an axis perpendicular to the ground plane. Disposing the golf tee at about a 5 degree angle with respect to the vertical axis in various directions can correct a hook, create or enhance a backspin, correct a slice, or enhance a drive such that the golf ball travels farther and in the desired direction.

There is none presently known that allows a golfer to precisely set a golf tee at a desired height and angle to correct or enhance a golfer's swing. Thus, it is desirable to design a multipurpose golf tool that fulfills this need and others.

SUMMARY OF THE INVENTION

In accordance with this invention, there is provided an improved golf tool comprising one or more of the following components: a golf tee height adjuster, a divot repairer, a club face cleaner, a ball marker, an object rest, a golf tee leveler, and a golf tee angle adjuster. In a preferred embodiment, all of these components are incorporated in the golf tool.

It is an object of the present invention to provide a golf tool that allows a golfer to set a golf tee at a plurality of predetermined angles.

It is an object of the present invention to provide a golf tool that allows a golfer to set a golf tee at about a 5 degree angle with respect to an axis perpendicular to the ground plane in various directions to assist the golfer to correct a hook or slice, create or enhance a backspin, or enhance a drive such that the golf ball travels farther and in the desired direction.

It is an object of the present invention to provide a multipurpose pocket sized golf tool.

It is an object of the present invention to provide a golf tool that allows a golfer to set a golf tee at a plurality of predetermined heights.

It is an object of the present invention to provide a golf tool that cleans golf clubs, provides a stand or holder for golf clubs, corrects divots, provides a golf ball marker, and sets a golf tee at a desired height and angle.

It is a further object of the present invention to provide a golf tool that is versatile and readily adaptable to different applications for a golfer.

It is a further object of the present invention to provide a golf tool that is simple to make and of light weight, so that it can be easily manufactured and used by amateur and professional golfers.

It is yet another object of this invention to provide a relatively simple golf tool that is economical for mass production from the viewpoint of the manufacturer and consumer, thereby making it economically available to the buying public.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

BRIEF DESCRIPTION OF THE DRAWINGS

The invention will be described by reference to the specification and the drawings, in which like numerals refer to like elements, and wherein:

FIG. 3 is a front orthogonal view of the multipurpose golf tool depicted in FIG. 1;

FIG. 4 is a rear orthogonal view of the multipurpose golf tool depicted in FIG. 1;

FIG. 4B is a close up view of 4B of FIG. 4;

Figure 1:
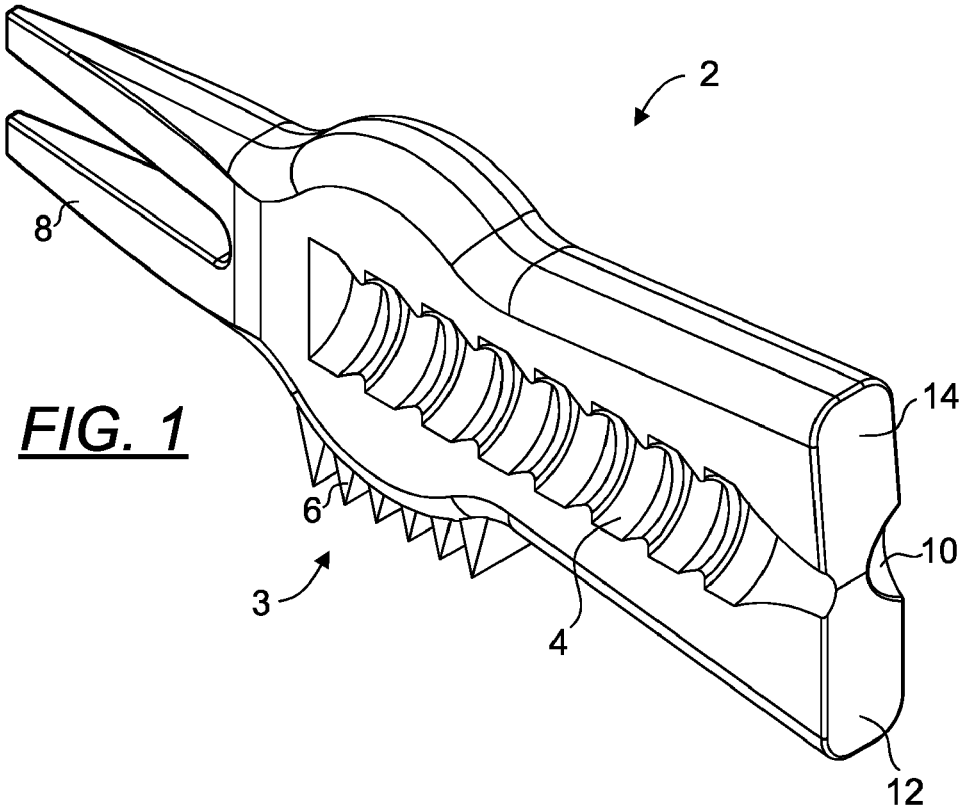
FIG. 1 is a rear perspective view of a multipurpose golf tool.

The drawings are not to scale, in fact, some aspects have been emphasized for a better illustration and understanding of the written description.

PARTS LIST

| | |
|---|---|
| 2 | golf tool |
| 3 | body |
| 4 | golf tee height adjuster |
| 5 | open end |
| 6 | club face cleaner |
| 8 | divot repairer |
| 10 | object rest cutout or depression |
| 12 | golf tee leveler |
| 14 | golf tee angle adjuster |
| 16 | ball marker storage recess |
| 17 | second round recess |
| 18 | magnetic disk |
| 20 | golf tee |
| 22 | ground or playing green |
| 24 | golf club |
| 26 | divot |
| 28 | ball marker |
| 30 | head of a golf club |
| 32 | length |
| 34 | width |
| 35 | central axis of golf tee height adjuster |
| 36 | thickness |
| 37 | storage recess's central axis |
| 38 | recesses |
| 39 | second recess's central axis |
| 40 | tee head channel |
| 41 | angle made between central axis of golf tee height adjuster and second side |
| 41A | offset angle |
| 42 | shoulder |
| 43 | angle made between central axis of golf tee height adjuster and first side |
| 44 | proximal end of the body |
| 46 | distal end of the body |
| 47 | ball marker portion |
| 48 | prong |
| 50 | prong |
| 52 | length |
| 54 | angular teeth |
| 56 | distance |
| 60 | diameter |
| 62 | diameter of magnetic disk |
| 64 | thickness of magnetic disk |
| 66 | end |
| 67 | distance |

PARTICULAR ADVANTAGES OF THE INVENTION

The golf tee angle adjuster allows a golfer to set a golf tee at a plurality of predetermined angles. In particular, the golf tool's angle adjuster allows a golfer to set a golf tee at about a 5 degree angle with respect to an axis perpendicular to the ground plane in various directions to assist the golfer to correct a hook or slice, create or enhance a backspin, or enhance a drive such that the golf ball travels farther and in the desired direction.

The pocket multipurpose golf tool is an all-in-one unit, compact in size, and incorporating a golf tee leveler, a golf tee angle adjuster, and one or more of the following components: a golf tee height adjuster, a divot repairer, a club face cleaner, a ball marker, and an object rest.

DETAILED DESCRIPTION OF THE INVENTION

Definitions

As used in this specification, a backspin means the backward rotation of the golf ball in flight along its horizontal axis (the top of the ball is rotating back towards the player), or the measured rate of that rotation. Aerodynamically, backspin produces lift which creates greater carry.

As used in this specification, a slice means a type of shot in which the ball curves in the shape of a banana, specifically, starting out to the left of the target and then bending dramatically back to the right of the target (for a right-handed golfer; reverse for left-handed golfers).

As used in this specification, a hook means a trajectory or ball flight in which the golf ball starts out to the right (for a right-handed golfer) before curving severely back to the left and missing its target to the left. (Reverse for left-handed golfers.) A hook is the opposite of a slice.

As used in this specification, a drive means the first shot on a hole hit from the teeing ground and generally refers to shots hit with a driver, 3-wood or 1-iron or driving iron.

As used in this specification, a tee shot means the first shot on a hole hit from the teeing ground with lesser clubs such as a 3-iron.

As used in this specification, shaft means the part of the club that extends from all the way to the top of the club inside the grip to the club head.

As used in this specification, club face means the striking surface, or the lofted part of the club head that makes contact with the ball.

As used in this specification, club head means the most massive part of the club at the bottom end (opposite the grip or handle) of the shaft, in other words, the part of the club that makes contact with the ball.

DESCRIPTION OF A PREFERRED EMBODIMENT

Figure 2:
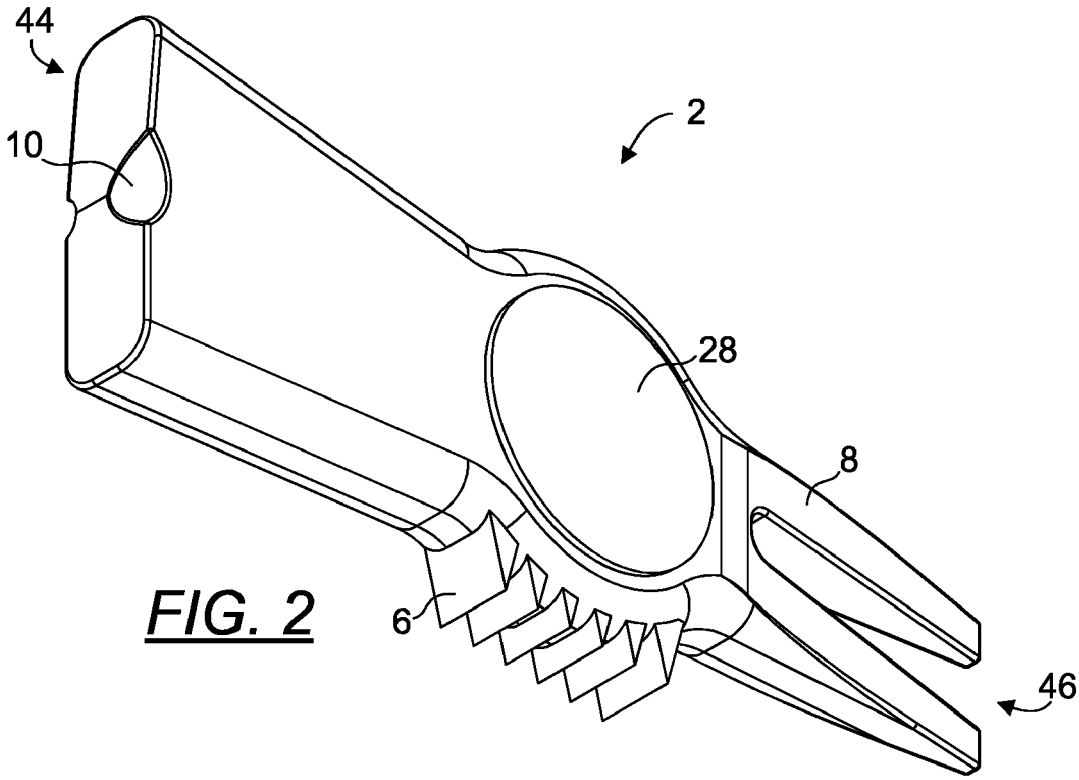
FIG. 2 is a front perspective view of a multipurpose golf tool depicted in FIG. 1.

FIG. 1 is a rear perspective view and FIG. 2 is a front perspective view of a preferred embodiment of a novel multipurpose golf tool 2. In a preferred embodiment, the golf tool 2 comprises a golf tee leveler 12, a golf tee angle adjuster 14, and one or more of the following components: a golf tee height adjuster 4, a divot repairer 8, a club face cleaner 6, a ball marker 28, and an object rest 10. The body 3 of the golf tool 2 may be any suitable shape so long as its profile defines the various tool components 4, 6, 8, 10, 12, 14, 16. Generally, a distal end 46 of the body 3 defines the divot repairer 8 and the opposing proximal end 44 defines the golf tee leveler 12 and golf tee angle adjuster 14. Depressions in the surface along the length of the body 3 define the golf tee height adjuster 4 and a depression on a central portion of the opposing side defines a recess 16 for storage of the ball marker 28. Protrusions from the central portion of the body define the club face cleaner 6.

Figure 5:
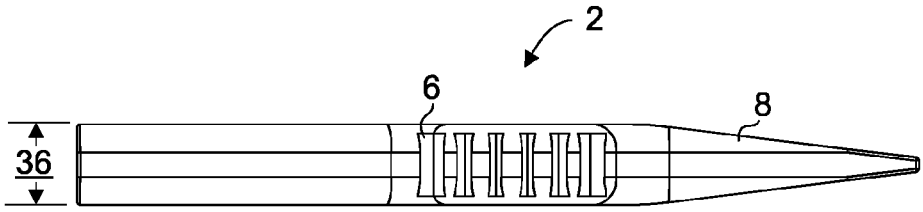
FIG. 5 is a plan view of the multipurpose golf tool depicted in FIG. 1.
Figure 6:
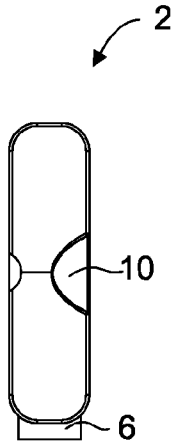
FIG. 6 is a an orthogonal view of the rear end of the multipurpose golf tool depicted in FIG. 1.
Figure 7:
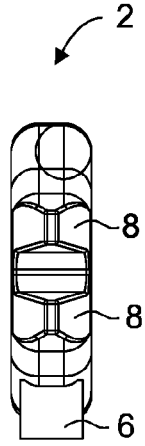
FIG. 7 is an orthogonal view of the front end of the multipurpose golf tool depicted in FIG. 1.

The golf tool 2 is small and unobtrusive, easily carried in a pocket. FIG. 3 is a front orthogonal view and FIG. 4 is a rear orthogonal view of the multipurpose golf tool 2 depicted in FIG. 1. FIG. 5 is a plan view. With reference to these drawings, one embodiment of the pocket-sized golf tool 2 has a length 32 of from about 2 to about 8 inches, preferably from about 3 to about 4 inches, and most preferably about 3.64 inches. The golf tool 2 has a width 34 at its widest point of from about 1 to about 3 inches, preferably from about 1.2 to about 2 inches, and most preferably about 1.39 inches. The golf tool 2 has a thickness 36 of from about 0.2 to about 1 inch, preferably from about 0.2 to about 0.5 inches, and most preferably about 0.36 inches. The thickness at the edges of the body 3 is shown in this particular embodiment to be a constant 0.36 inches, but may range along the length of body 3 from about 0.2 to about 0.5 inch.

Additionally, indicia, such as company logos, symbols, etc. may be imprinted, embossed or affixed (via adhesive or mechanical fastener) on the exterior surface of body 3, such as for advertising or other purposes. Indicia, such as golf tee height markings or measurements, or labeling of the angles of the golf tee leveler 12 and/or golf tee angle adjuster 14 may also be imprinted, embossed or affixed (via adhesive or mechanical fastener) on the exterior surface of body 3.

Golf Tee Height Adjuster 4

Figure 8:
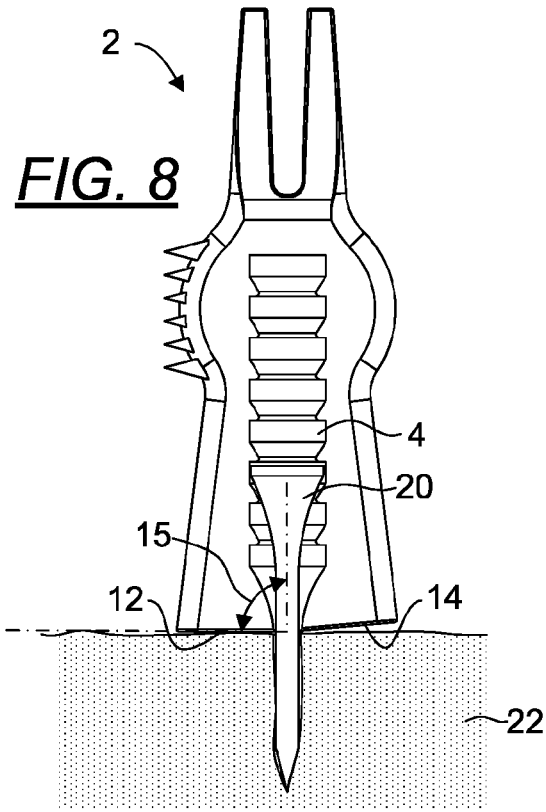
FIG. 8 is an orthogonal view of the multipurpose golf tool depicted in FIG. 1 in use as a guide to insert a golf tee in the ground using the golf tee leveler component.
Figure 9:
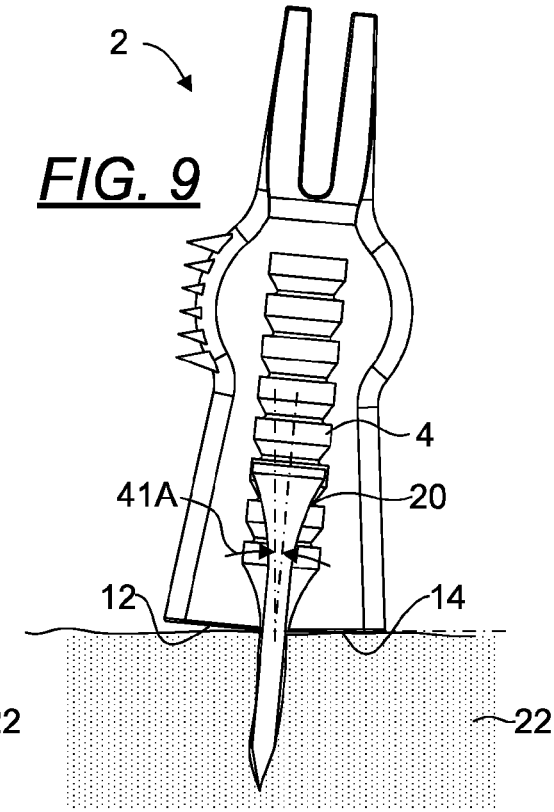
FIG. 9 is an orthogonal view of the multipurpose golf tool depicted in FIG. 1 in use as a guide to insert a golf tee in the ground using the tee angle adjuster component.

The golf tee height adjuster 4 comprises a series of recesses 38 on the rear face defined to position a golf tee at one of a several predetermined heights from the ground. FIG. 4B is a close up view of 4B of FIG. 4. FIG. 8 is an orthogonal view of the multipurpose golf tool 2 depicted in FIG. 1 in use as a guide to insert a golf tee 20 in the ground 22 in a level position, that is, substantially perpendicular to the ground. However, the golf tee height adjuster 4 also works in conjunction with the golf tee angle adjuster 14. FIG. 9 is an orthogonal view of the multipurpose golf tool 2 depicted in FIG. 1 in use as a guide to insert a golf tee 20 in the ground 22 at a predetermined angle of from 83 to 90 degrees with respect to the ground plane.

Differing shaft length and club head size requires adjustments to golf tee height for the golfer to hit the golf ball with the middle or upper portion of the club face when making a tee shot. For example, a taller club face generally requires a higher tee height for the golfer to hit the golf ball with the middle of the club face. Also, if maximum height is desired on a tee shot, it is preferable to tee the golf ball higher than the true middle of the club face to launch the golf ball higher while minimizing backspin. The golf tee height adjuster 4 offers the experienced golfer a consistent teeing height every time. For beginning players, a consistent teeing height is particularly difficult to achieve, and the teeing process itself can be difficult as well, particularly when inserting a golf tee 20 into harder ground 22. The golf tool 2 of the present invention also eases the mechanics of the teeing process for the golfer by providing support to the golf tee 20 during its insertion into the ground 22 while producing a consistent teeing height.

One face of the golf tool 2 body 3 defines a series of aligned and connecting recesses 38 that accommodate at least a portion of a conventional golf tee 20. The series of recesses 38 are configured to measure and set a golf tee 20 a desired distance to position a golf ball at one of a plurality of predetermined distances above the ground 22. The predetermined distances are in the range of from about 0.25 to about 3.5 inches, preferably between about 0.5 and about 2.25 inches. The predetermined distances are disposed in about 0.25 inch increments.

In the embodiment depicted, there are provided a series of eight recesses 38. Each recess 38 comprises a tee head channel 40 whose profile accommodates and generally conforms to the head of a golf tee 20 with a diameter of about 0.5 inch and a thickness of about 0.130 inch. Each recess 38 comprises a shoulder 42 of about 0.07 to about 3/16 inch that generally conforms to the shoulder of a conventional golf tee 20 and defines the distance between each tee head channel 40. In one preferred embodiment, each shoulder 42 tapers inwardly about 0.050 inch. Each recess 38 (tee head channel and shoulder) in the series extends a distance of from about 0.20 to about 0.25 inch and is about 0.230 inch deep at its deepest point. Each recess 38 in the series is disposed such that the recesses 38 are adjoining and the respective cavities are in communication with one another. The tee head channel 40 of the lowest recess 38 is disposed a distance of about 0.66 inch from the outer surface of the proximal end 44 of the body 3.

Referring to FIGS. 4, 4B, 8 and 9, the open end 4 of the recess 38 along the proximal end 44 of the body 3 allows the shank of a conventional golf tee 20 to protrude outwardly from the golf tool 2 body 3 in a manner that it can be set into the ground 22. When in use, the proximal end 44 of the body 3 is in contacting engagement with the ground 22 (see FIGS. 8 and 9). Preferably, a golfer uses the golf tee leveler 12 or a golf tee angle adjuster 14 in conjunction with the golf tee height adjuster 4.

In one preferred embodiment (not depicted), the open end 5 is disposed about the midpoint of a rounded cutout or recess similar to that depicted and described with respect to object rest 10. In one embodiment, the open end comprises a void or opening about 0.5 inches wide, or with a radius of about 0.375 inch, and about 3/8 inch deep, but it is not so limited. The open end may be formed in a different shape or size as long as it sufficiently guides a golf tee during the insertion process (into the ground).

In yet another embodiment, there is provided a rounded depression or recess along the proximal end 44 on both opposing faces of the body 3. The depression that coincides with the golf tee height adjuster 4 provides a means for a finger to easily grip the golf tee 20 for insertion and removal.

In one aspect, the tool 2 may include height indicia to identify the resulting height the ball will be set above the ground. Such height indicia may include, but is not limited to, a visible height identification marker and/or a tactile height identification marker. By way of illustration, a visible height identification marker includes an alphanumeric reference (e.g., 1, 2, 3 or A, B, C, and the like) or a measurement (e.g., ½ inch, 5 mm, or the like). Another exemplary visible height identification indicia includes a color-coded system where the entire tool 2 or a portion of tool 2 is marked with a number, letter, or color which corresponds to the particular height the ball will be placed above the ground 22 using that recess 38. Another exemplary tactile height identification system includes a system where tool 2 is marked with indentations, detents, surface patterns, or the like which corresponds to the particular height the ball will be placed above the ground 22 using that recess of the tool 2. According to an exemplary embodiment, indicia may include both a visible and tactile height identification system using colored recesses.

Further alternate embodiments position the recess in other locations on the body 3, or use other geometrical shapes to indicate the height, including a depression or depressions with or without color coding in or on the front or rear surfaces of the tool 2. Still further alternate embodiments could also use color, patterns or tactile features over part of the tool's body 3 or over the entire tool 2 to indicate teeing height.

In using the tee height adjuster, a golfer preferably places a golf tee in the ground such that at least one half, and more preferably, at least two thirds, of the golf ball is above the crown when the golf ball is teed up.

Divot Repairer 8

Figure 11:
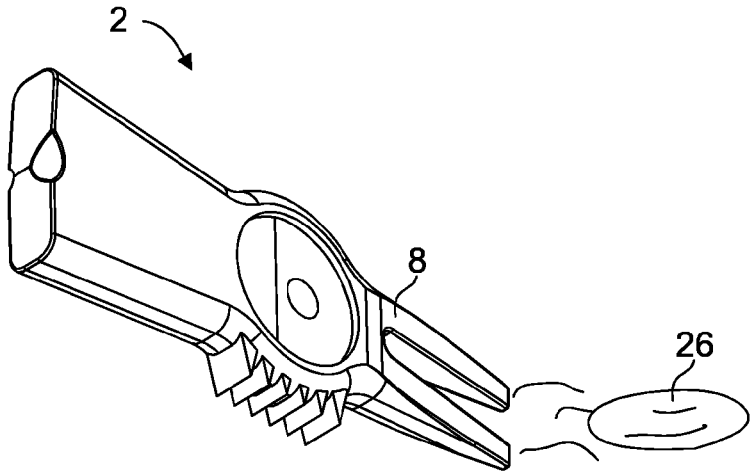
FIG. 11 is a perspective view of the multipurpose golf tool depicted in FIG. 1 being used to repair a divot.

FIG. 11 is a perspective view of the multipurpose golf tool 2 depicted in FIG. 1 being used to repair a divot with the divot repairer 8 component. Referring to FIGS. 3 and 11, the divot repairer 8 preferably comprises two gently tapered prongs 48, 50. In one aspect, the prongs 48, 50 taper from a width of 0.36 inch at the body 3 to a width of 0.0614 inch at the distal end 46 over a distance of 1.277 inches. As will be apparent, the tapering of the prongs creates a sharper point at the distal end to facilitate digging and/or protruding through the ground surface 22.

Alternatively, a single prong, or three or more prongs, may be used in various embodiments. Each prong 48, 50 preferably has a length 52 of from about 1 to about 2 inches, preferably from about 1.125 to about 1.375 inches. This component 8 may be used to repair a divot 26 or a ball mark in a conventional manner.

Object Rest 10

Figure 10:
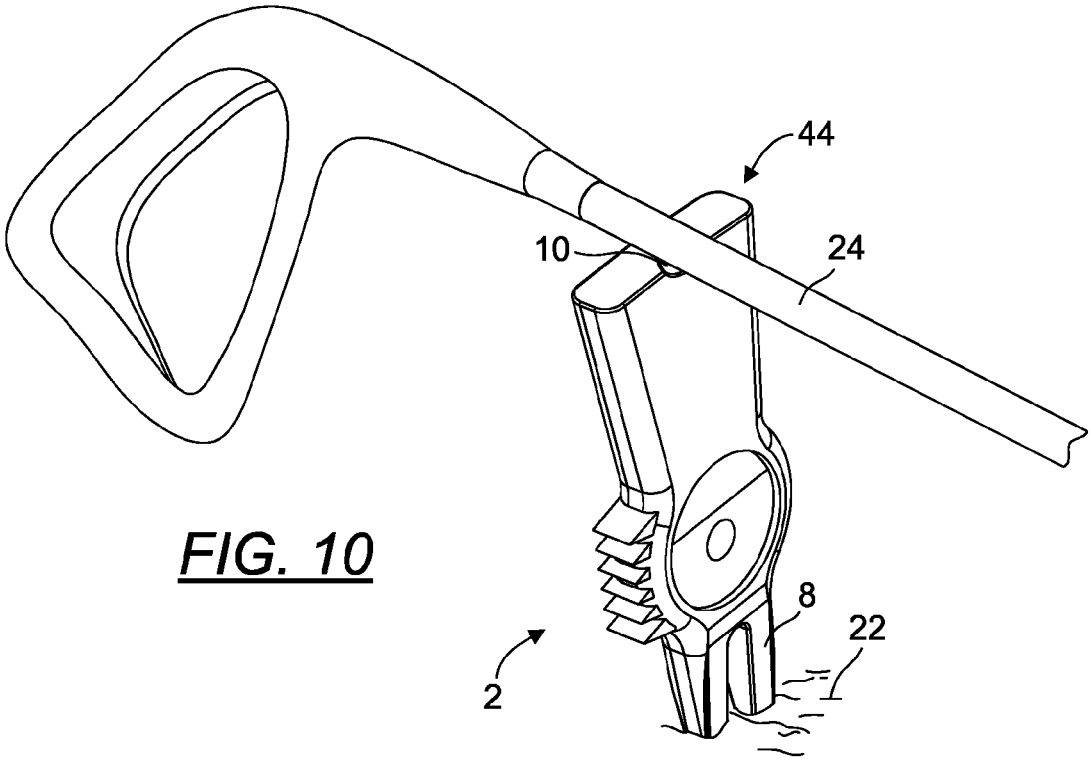
FIG. 10 is a perspective view of the multipurpose golf tool depicted in FIG. 1 in use holding a golf club off the ground.

FIG. 10 is a perspective view of the multipurpose golf tool 2 depicted in FIG. 1 in use holding a golf club 24 off the ground 22. Referring to FIGS. 3 and 10, the golf tool 2 may be anchored in the ground 22 with the prongs 48, 50 of the divot repairer 8 and disposed in an upright position (with the proximal side 44 of the body 3 upward) such that the cutout or depression 10 on the rear face functions as a holder or rest for an object such as a cigar, cigarette or golf club shaft 24. In one aspect, the cutout or depression has a radius of 0.375 inch. When the golf tool 2 is so positioned, one end of an object rests within the depression 10 or cutout such that it is propped off the ground 22 and/or its tendency to roll away is inhibited. This may provide a convenience to the golfer in being able to keep a golf club 24 or cigar clean, keep it from rolling, or to easily locate it upon completion of a golf swing.

Club Face Cleaner 6

Figure 13:
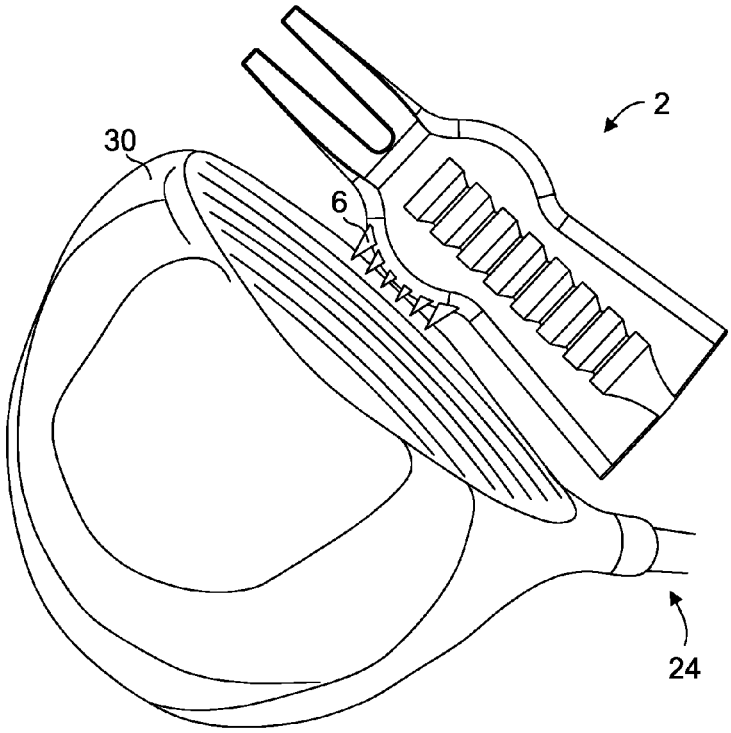
FIG. 13 is a perspective view of the multipurpose golf tool depicted in FIG. 1 in use cleaning a golf club.

FIG. 13 is a perspective view of the multipurpose golf tool 2 depicted in FIG. 1 in use cleaning a head 30 of a golf club 24. Referring to FIGS. 4 and 13, the club face cleaner 6 preferably comprises a plurality of angular teeth 54 protruding outwardly from the surface of one side of the body 3. In one aspect (not depicted), a club face cleaner is disposed on both sides of the body 3. In the embodiment depicted, there are provided 6 teeth 54 whose points are disposed a distance 56 of about 0.14 inch apart, however, more or less teeth 54 may be utilized to provide the intended function of this component 6. Each tooth 54 preferably has a length of from about 0.05 to about 0.30 inches, preferably about 0.15 inches. The teeth 54 may be different or the same height and/or width. In a preferred embodiment, the teeth 54 are slightly resilient to enhance the cleaning capability of this component 6.

In one aspect (not depicted), the teeth 54 can be made to withdraw into the tool 2. Teeth 54 may be formed of the same material as body 3, or may be formed of one or more different materials such as, but not limited to, nylon, brass, bristle material, stainless steel, hair, and polyester. In another embodiment the teeth 54 are oriented in a slightly downward angle to increase the amount of force a user can exert.

Ball Marker 28

Figure 12:
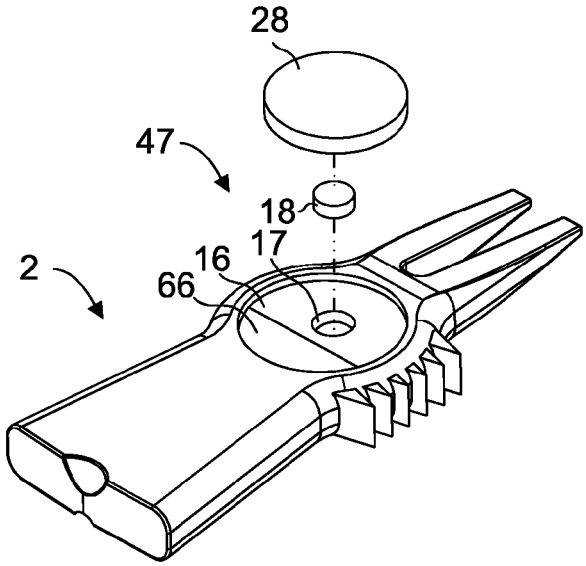
FIG. 12 is a perspective view of the multipurpose golf tool depicted in FIG. 1 showing the ball marker portion in greater detail.
Figure 12A:
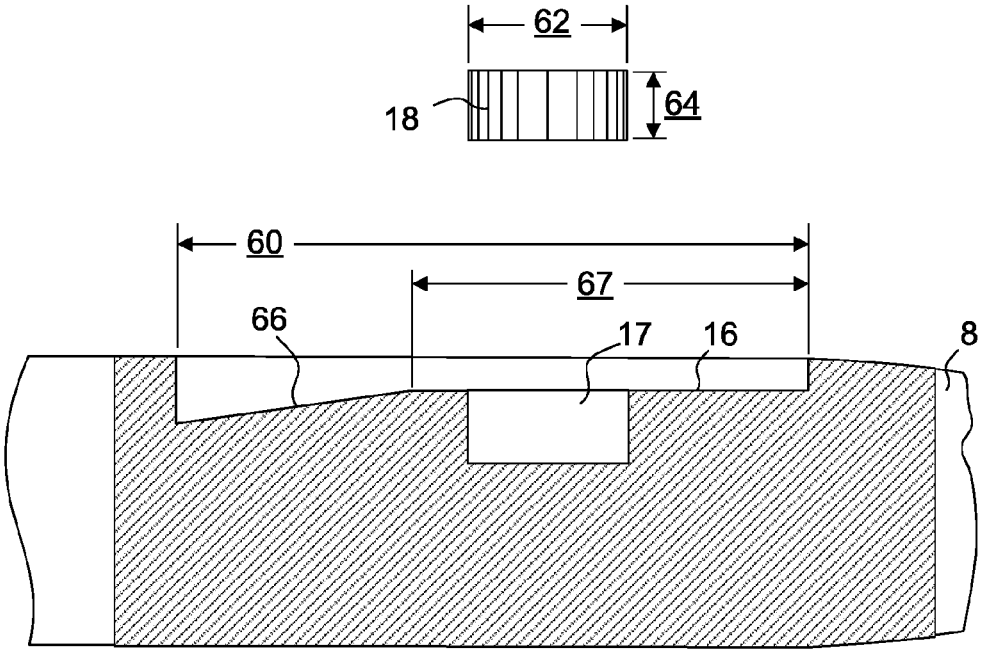
FIG. 12A is a cutout view along Section AA of FIG. 3.

FIG. 12 is a perspective view of the multipurpose golf tool 2 depicted in FIG. 1 showing the ball marker 28 portion 47 in greater detail. FIG. 12A is a cutout view along Section AA of FIG. 3. On the front face of the body 3 is a round storage recess 16 that holds a magnetic disk 18 and a metallic ball marker 28. In the embodiment depicted, the storage recess 16 has a diameter 60 of about 0.781 inch. The diameter 60 is preferably about the size of a United States or Canadian quarter such that a coin may be used to replace the ball marker 28 if it is misplaced. In another embodiment, the storage recess 16 has a diameter 60 of about the size of a United States or Canadian dime or any conventional ball marker 28.

The recess is sized and configured to receive a ball marker 28 such that it is flush with the peripheral surface of the body 3. The floor of the storage recess 16 has a second round recess 17 that receives a magnetic disk 18 having a diameter 62 of about 6 millimeters and a thickness 64 of about 1.5 millimeters such that the top surface of the magnetic disk is substantially flush with the floor of the storage recess 16. The magnetic disk 18 is preferably a rare earth magnet such as neodymium and is secured to the body 3 by adhesive, compression fit or other means.

In one aspect, the depth of the storage recess 16 is not uniform. At one end 66, the storage recess 16 is deeper to allow a finger to easily dislodge the ball marker 28 from the storage recess 16 and magnetic disk 18. The ball marker 28 may be dislodged by applying fingertip pressure to the seated ball marker 28 at end 66. As will be apparent, applying pressure to the portion of the ball marker disposed at end 66 will cause the one end of ball marker 28 to tip into the deeper portion of the recess (at end 66) and correspondingly raise the opposing end above the surface of the body 3 in a manner that it 28 may be easily gripped and removed. In one embodiment, the deeper end 66 is gently tapered to a depth that is up to twice the depth of the remaining portion of the storage recess 16 and/or to a depth that corresponds to the depth of the magnetic disk holding second recess 17. The second recess is positioned such that its central axis 39 is offset from the central axis 37 of the storage recess 16 to facilitate easier removal of the ball marker 28 from the storage recess 16 during use. In the embodiment depicted, the central axis 37 of storage recess 16 is disposed at a distance of 0.625 inch from the central axis 39 of second recess 17. In one embodiment, the second recess is disposed at the opposing side of the storage recess 16 away from the deeper end 66 of the recess.

Additionally, indicia, such as company logos, symbols, etc. may be imprinted, embossed or affixed (via adhesive or mechanical fastener) on the exterior surface of magnetic disk 28, such as for advertising or other purposes.

Golf Tee Leveler 12 and Golf Tee Angle Adjuster 14

Referring to FIGS. 4, 8 and 9, the body 3 further contains a golf tee leveler 12 and a tee angle adjuster 14 that allows a golfer to place a golf tee 20 at one of a plurality of tee angles. The profile of the body's 3 peripheral edge along the proximal end 44 forms both the golf tee leveler 12 and a golf tee angle adjuster 14. The proximal end comprises a planar first side on which the golf tee leveler 12 is disposed and a planar second side on which the golf tee angle adjuster 14 is disposed. The proximal end is asymmetric along the peripheral edge. The first side and second side intersect pivotably to form an intersection line, wherein the planar first side is disposed at an angle to the planar second side and the central axis of the golf tee height adjuster penetrates the intersection line and is disposed perpendicularly thereof, thereby forming a golf tee leveler disposed on the first side of the proximal end and having an angle of from 89 to 91 degrees between a central axis 35 of the golf tee height adjuster and the peripheral edge of the proximal end for guiding an insertion of the golf tee into the ground at an angle substantially perpendicular to the ground plane. When a golf tee 20 is inserted in the ground 22 using the golf tee leveler 12, the golf tee 20 is disposed at about an angle of from about 89 to about 91 degrees, preferably 90 degrees with respect to the ground 22.

The second side is a tee angle adjuster 14 and disposes a golf tee 20 at an angle 41 of from about 4 to about 7 degrees, preferably about 5 degrees, with respect to the axis perpendicular to the ground plane. To achieve this position, the proximal 44 end portion where the tee adjuster is disposed is positioned flat on the ground 22 and is sloped or unfigured such that an angle 41 of from about 83 to about 89 degrees, preferably 85 degrees is formed between the central axis 37 of the golf tee height adjuster 4 and the proximal end 44 surface of golf tool 2. Placing the golf tee 20 at such an angle 41 corrects or enhances a golf swing. By way of illustration, disposing the golf tee 20 at about a 5 degree angle to the left of the golfer may correct a hook. By way of further illustration, biasing the golf tee 20 at about a 5 degree angle forward of the golfer may create or enhance a backspin. By way of further illustration, biasing the golf tee 20 at about a 5 degree angle to the right of the golfer may correct a slice. By way of further illustration, biasing the golf tee 20 at about a 5 degree angle back, or toward, the golfer may enhance a drive such that the golf ball travels farther.

Another Embodiment of the Portable Multipurpose Golf Tool

As previously described, the portable multipurpose golf tool has a body with a front face, a back face, a distal end and a proximal end. There is provided a series of recesses on the back face, adapted to receive a portion of a standard golf tee with a head or circular top end and a shank or spiked bottom end, thereby providing a means for setting the spiked bottom portion of the golf tee while the circular top end of the golf tee is concurrently mounted in one of the recesses. There is additionally provided a golf tee angle adjuster disposed on the proximal end, having at least one planar surface having an offset angle 41A with respect to a planar surface containing circular top edge of golf tee, thereby providing the golf tee with a predetermined angle 41, 41A with respect to a playing green substantially equal to the offset angle 41A.

Materials and Manufacturing Methods

The golf tool 2 is preferably constructed from a material that holds its shape. The golf tool 2 is preferably sturdy, but can also be pliable, as long as the tool 2 provides sufficient structural integrity to support the pressures exerted on it during its use. According to one embodiment, the golf tool 2 is moisture repellant or resistant, such that it resists corrosion from exposure to the elements and changes in size. The golf tool 2 is constructed of a material such as wood, metal, plastic, combinations and/or mixtures thereof. An exemplary material of the golf tool 2 is a moldable thermoplastic such as nylon or polypropylene. The golf tool 2 may be of unibody design, i.e., it is formed from a single piece of material with no moving parts.

On one aspect, the golf tool 2 is manufactured by an injection molding process with a thermoplastic. While many thermoplastics may be suitable used with the present invention, Applicant believes that pure nylon is subject to excessive shrinkage and pure polypropylene does not have suitable strength. Preferably, the thermoplastic comprises from about 5% to about 50%, preferably from about 10% to about 33% (by volume), of a filler such as fiberglass to reduce shrinkage and/or increase strength. Polypropylene exhibits the best color characteristics for colored plastic golf tools. Thus, the most preferable material is polypropylene with about 10 volume percent fiberglass.

The tool 2 may also be formed from separate components. An exemplary embodiment of the tool 2 formed from separate or multiple components is an embodiment where the length of tool body 3 is adjustable; thereby further allowing a golfer to select the desired height that a golf ball is to be teed above the ground 22. The length of body 3 may be made adjustable through telescope expansion of the body 3, two or more body 3 components in an adjustable, e.g. threaded, connection, or friction fit configuration. Another exemplary embodiment is the body 3 molded from thermoplastic and the protrusions or bristles of the golf club face cleaner 6 formed and/or the prongs 48, 50 of the divot repairer 8 of a metallic or harder plastic material and fixed to the body 3.

As such, those skilled in the art will appreciate that the conception, upon which this disclosure is based, may readily be utilized as a basis for the designing of other structures for carrying out the several purposes of the present invention. It is important, therefore, that the invention be regarded as including such equivalent construction insofar as they do not depart from the spirit and scope of the conception regarded as the present invention.

We claim:

1. A pocket multipurpose golf tool having a body with a front face, a rear face, a distal end and a proximal end thereof, and having a golf tee height adjuster comprising a series of recesses on the rear face for positioning a head of a golf tee at one of a plurality of predetermined heights from the ground, wherein the ground has a ground plane, and further having a golf tee angle adjuster disposed on the proximal end formed by a sloped edge having an angle of from 83 to 89 degrees between a central axis of the golf tee height adjuster and a surface of the proximal end for guiding an insertion of the golf tee into the ground at a predetermined angle of from 4 to 7 degrees with respect to an axis perpendicular to the ground plane.

2. The pocket multipurpose golf tool of claim 1 wherein the sloped edge has an angle of 85 degrees for guiding an insertion of the golf tee into the ground at a predetermined angle of 5 degrees with respect to an axis perpendicular to the ground plane.

3. The pocket multipurpose golf tool of claim 2 wherein the golf tee angle adjuster is adapted to guide the insertion of the golf tee into the ground at the predetermined angle of 5 degrees toward a left side of a golfer thereby providing a hook correcting golf tool.

4. The pocket multipurpose golf tool of claim 2 wherein the golf tee angle adjuster is adapted to guide the insertion of the golf tee into the ground at the predetermined angle of 5 degrees toward a right side of a golfer thereby providing a slice correcting golf tool.

5. The pocket multipurpose golf tool of claim 2 wherein the golf tee angle adjuster is adapted to guide the insertion of the golf tee into the ground at the predetermined angle of 5 degrees toward a front side of a golfer thereby providing a backspin enhancing golf tool.

6. The pocket multipurpose golf tool of claim 2 wherein the golf tee angle adjuster is adapted to guide the insertion of the golf tee into the ground at the predetermined angle of 5 degrees toward a golfer thereby providing a drive distance enhancing golf tool such that a golf ball travels a greater distance when hit by the golfer.

7. The pocket multipurpose golf tool of claim 1 further comprising at least one component selected from the group consisting of a golf tee leveler, a divot repairer, a club face cleaner, a ball marker, and an object rest.

8. A pocket multipurpose golf tool having a body with a front face, a rear face, a distal end and a proximal end thereof, and having a golf tee height adjuster comprising a series of recesses on the rear face for positioning a head of a golf tee at one of a plurality of predetermined heights of from 0.5 inch to 2.25 inches from the ground, wherein each recess comprises a tee head channel having a profile that accommodates and generally conforms to the head of the golf tee, wherein the proximal end has a peripheral edge, comprising a planar first side and a planar second side thereof, and is asymmetric along the peripheral edge of the proximal end such that the first side and second side intersect pivotably to form an intersection line, wherein the planar first side is disposed at an angle to the planar second side and the central axis of the golf tee height adjuster penetrates the intersection line and is disposed perpendicularly thereof, thereby forming a golf tee leveler disposed on the first side of the proximal end and having an angle of from 89 to 91 degrees between a central axis of the golf tee height adjuster and the peripheral edge of the proximal end for guiding an insertion of the golf tee into the ground at an angle substantially perpendicular to the ground plane.

9. The pocket multipurpose golf tool of claim 8 wherein the distal end of the body forms a divot repairer and the opposing proximal end forms the golf tee leveler, wherein the divot repairer comprises a plurality of tapered prongs such that a sharper point is formed at a distal end of the plurality of tapered prongs to facilitate digging, and the golf tool is adapted to be anchored in the ground with the plurality of tapered prongs and disposed in an upright position with the proximal side of the body upward such that a depression on the rear face functions as an object rest whereby an end of an object rests within the depression such that the object is propped off the ground and a tendency to roll away is inhibited.

10. A pocket multipurpose golf tool comprising a golf tee height adjuster, a divot repairer, a club face cleaner, a ball marker, an object rest, a golf tee leveler, and a golf tee angle adjuster wherein the golf tee height adjuster comprises a series of recesses on the rear face for positioning a head of a golf tee at one of a plurality of predetermined heights of from 0.5 inch to 2.25 inches from the ground, wherein each recess comprises a tee head channel having a profile that accommodates and generally conforms to the head of the golf tee, the proximal end has a peripheral edge, a first side and a second side thereof, and is asymmetric along the peripheral edge of the proximal side such that the first side and second side form different angles between a central axis of the golf tee height adjuster and an axis perpendicular to the ground plane, the golf tee angle adjuster is disposed on the proximal end formed by a sloped edge having an angle of from 83 to 89 degrees between a central axis of the golf tee height adjuster and a surface of the proximal end for guiding an insertion of the golf tee into the ground at a predetermined angle of from 4 to 7 degrees with respect to an axis perpendicular to the ground plane, the golf tee leveler is disposed on the first side of the proximal end and has an angle of from 89 to 91 degrees between a central axis of the golf tee height adjuster and the peripheral edge of the proximal end for guiding an insertion of the golf tee into the ground at a substantially perpendicular angle with respect to an axis perpendicular to the ground plane, a distal end of the body forms the divot repairer, wherein the divot repairer comprises a plurality of tapered prongs such that a sharper point is formed at a distal end of the plurality of tapered prongs to facilitate digging, a depression on a central portion of the back face forms a storage recess for storage of a ball marker, and wherein the storage recess holds a magnetic disk and a metallic ball marker and is configured to receive the ball marker such that the ball marker is flush with a peripheral surface of the body when the ball marker is disposed in the storage recess, and wherein the magnetic disk comprises a rare earth magnet, and a plurality of outwardly extending angular protrusions from a first side of a central portion of the body form the club face cleaner.

11. The pocket multipurpose golf tool of claim 10 wherein the storage recess has a diameter substantially the same as a coin diameter of a United States quarter or dime.

12. The pocket multipurpose golf tool of claim 10 wherein a floor of the storage recess has a central axis and a second recess disposed therein that receives the magnetic disk such that a top surface of the magnetic disk is substantially flush with the floor of the storage recess and wherein the second recess has a second central axis positioned such that the second central axis is offset from the central axis of the storage recess thereby facilitating easier removal of the ball marker from the storage recess during use.

13. The pocket multipurpose golf tool of claim 10 wherein a depth of a floor of the storage recess is not uniform such that the depth of the floor at the proximal end is deeper than the depth of the floor at the distal end thereby allowing a finger to easily dislodge the ball marker from the storage recess and the magnetic disk.

14. The pocket multipurpose golf tool of claim 10 further comprising markings for golf tee height measurement markings and angle markings labeling the angles of the golf tee leveler and the golf tee angle adjuster wherein the angle markings and golf tee height measurement markings are disposed on a peripheral surface of the body.

15. The pocket multipurpose golf tool of claim 10 further comprising a first depression along the proximal end on the front face and a second depression along the proximal end on the back face such that the first and the second depressions facilitate a finger of a golfer easily gripping the golf tee for insertion and removal from the golf tee height adjuster.

16. A portable multipurpose golf tool comprising a body having a front face, a rear face, a distal end and a proximal end thereof, and a plurality of recesses on the rear face, adapted to receive a portion of a golf tee having a circular top end and a spiked bottom end, wherein when the golf tee is received in one of the plurality of recesses, the spiked bottom end extends from the proximal end thereby providing a means for setting the spiked bottom portion of the golf tee while the circular top end of the golf tee is concurrently mounted in one of the plurality of recesses, and a golf tee angle adjuster disposed on the proximal end, having at least one planar surface having an offset angle possessing a range from 4 to 6 degrees with respect to a planar surface containing circular top edge of golf tee, thereby providing the golf tee with a predetermined angle with respect to a playing green substantially equal to the offset angle.

17. The portable multipurpose golf tool of claim 16, wherein the offset angle is 5 degrees, thereby providing a slice correcting means by enabling a user to easily set the golf tee having a 5 degree bias toward a right side of the user.

* * * * *